US008800578B2

(12) United States Patent
Jackson

(10) Patent No.: US 8,800,578 B2
(45) Date of Patent: Aug. 12, 2014

(54) ICE RESCUE WALKING STAFF

(76) Inventor: Donald William Jackson, Inverary (CA)

( * ) Notice: Subject to any disclaimer, the term of this patent is extended or adjusted under 35 U.S.C. 154(b) by 123 days.

(21) Appl. No.: 13/487,211

(22) Filed: Jul. 12, 2012

(65) Prior Publication Data

US 2014/0014149 A1 Jan. 16, 2014

(51) Int. Cl.

| | |
|---|---|
| ***A45B 3/00*** | (2006.01) |
| ***B63C 9/32*** | (2006.01) |
| ***A63C 11/22*** | (2006.01) |

(52) U.S. Cl.

CPC ... *A45B 3/00* (2013.01); *B63C 9/32* (2013.01); *A63C 11/22* (2013.01)

USPC ..... 135/66; 135/69; 135/77; 280/819; 441/80; 441/82

(58) Field of Classification Search

USPC ..... 135/65–66, 69, 72, 76, 77; 280/809, 280/819, 821–824; 43/18.1 R, 18.1 CT, 43/18.1 HR, 21, 42, 22, 86–87; 294/76, 294/19.3, 119.2, 191; 441/56, 58, 65, 68, 441/69, 80, 82; 119/801–804

See application file for complete search history.

(56) References Cited

U.S. PATENT DOCUMENTS

| | | | | | |
|---|---|---|---|---|---|
| 1,443,121 | A | * | 1/1923 | Fogg | 441/85 |
| 2,445,344 | A | * | 7/1948 | Wachtel | 280/812 |
| 2,499,511 | A | * | 3/1950 | Koger | 119/803 |
| 2,704,052 | A | * | 3/1955 | Wood | 119/804 |
| 3,272,210 | A | * | 9/1966 | Boruvka | 135/69 |
| 3,350,111 | A | * | 10/1967 | Sahlein et al. | 280/813 |
| 3,866,619 | A | * | 2/1975 | Per Frisk | 135/114 |
| 4,299,409 | A | * | 11/1981 | Gedicks | 280/819 |
| 4,351,126 | A | | 9/1982 | Simonson | |
| 4,358,138 | A | * | 11/1982 | Laughlin et al. | 280/819 |
| 4,593,933 | A | * | 6/1986 | Nunno | 280/812 |
| 4,599,074 | A | | 7/1986 | Beckly | |
| 4,661,077 | A | | 4/1987 | Griffith | |
| 4,713,033 | A | | 12/1987 | Cameron | |
| 4,815,997 | A | * | 3/1989 | Forsmark et al. | 441/82 |
| 5,116,093 | A | | 5/1992 | Burns | |
| 5,329,873 | A | * | 7/1994 | Tiballi | 116/173 |
| 5,586,514 | A | | 12/1996 | Yuscavage | |
| 5,628,538 | A | | 5/1997 | Ericksen | |
| 5,752,731 | A | | 5/1998 | Crone | |

(Continued)

FOREIGN PATENT DOCUMENTS

| | | | | |
|---|---|---|---|---|
| CA | 2082115 | A1 | 8/1993 | |
| CA | 2679396 | A1 | 2/2010 | |
| WO | WO 9105930 | A1 * | 5/1991 | E04H 12/22 |

*Primary Examiner* — Winnie Yip

(57) ABSTRACT

A multifunctional walking staff, to aid in balance and support on an ice surface, and to function as a survival or a rescue tool in the event of breaking through thin ice into water. Secure traction on ice is attained by a metal tip, which may be further pressed onto the ice by a foot peg, serving also as a grapple hook. Secured onto the ice, the staff affords reliable anchorage to an attached rescue line, which is ordinarily stowed in multiple folds therewithin. An adjustable loop is formed integrally with, or adjoined to the rescue line, which loop may be maneuvred by the staff to facilitate engagement with the rescuee. A buoyant projectile linked to the loop is releasably disposed within a top section of the staff, and is of such weight that it and the loop may jointly be cast the full extent of the rescue line.

17 Claims, 9 Drawing Sheets

(56) References Cited

U.S. PATENT DOCUMENTS

| | | | | |
|---|---|---|---|---|
| 5,827,098 | A | 10/1998 | Cunningham | |
| 6,450,557 | B1 | 9/2002 | Martinez | |
| 6,575,799 | B1 | 6/2003 | Stimpson | |
| 6,659,823 | B1 | 12/2003 | Mosna | |
| 8,627,839 | B1 * | 1/2014 | Martinez | 135/66 |

* cited by examiner

3A

3B

21

22

26

ICE RESCUE WALKING STAFF

CROSS-REFERENCE TO RELATED APPLICATIONS

Not applicable.

STATEMENT REGARDING FEDERALLY SPONSORED RESEARCH OR DEVELOPMENT

Not applicable

BACKGROUND OF THE INVENTION

I. Field of the Invention

The present invention relates generally to both the field of mobility assistance devices and the field of rescue and survival equipment. In particular, the present invention relates to a multifunctional winter walking staff which may serve as a means of survival in the event of breaking through thin ice into frigid water, or a means of rescue of a person or an animal who suffered such an event.

II. Brief Description of the Prior Art

Winter in northern climes presents a harsh, inhospitable environment to those who venture outdoors. Yet, the stark beauty of winter landscapes and the many opportunities for sport and recreation it offers are sufficiently rewarding to draw great many people outdoors in wintertime. Of the challenges attendant to winter outings, traversal of icy surfaces is particularly and insidiously perilous. Slipping on ice is an ever-present danger, one with potentially disastrous consequences when slipping off an ice ledge into frigid water. Similarly disastrous, but oftentimes unheeded, is the danger of breaking through thin ice into frigid water. The rapidity at which hypothermia sets in and the difficulty of climbing back onto the surrounding ice combine to render these events potentially lethal. (In this description and in the appended claims, an ice surface failure or any other departure from an ice surface which results in Inadvertent Immersion in Frigid Water is termed an "IIFW event").

The aforementioned problems associated with traversing an ice surface can be mitigated in three ways: prevention, survival, and rescue. To reduce the risk of slipping on ice, traction augmentation devices have traditionally been used. Shoes and boots have been fitted with anti-slip soles, spiked cleats—integrated with the sole or mounted on a detachable frame (crampons)—and even strap-on chains. Though effective on ice, such specialized footwear must, inconveniently, be replaced with ordinary footwear off the ice (or fittings removed and carried along). Less effective, but more convenient means of prevention are walking canes fitted with pointed tips. One example of such an adaptation of a walking cane is proposed in patent application CA2082115A1 (Stewart Lewis, 1993); another, in patent application CA2679396A1 (Brian Mcgann, 2010).

Prevention of an IIFW event, of course, is best assured by avoiding thin ice areas of frozen lakes and rivers. Such surfaces, unfortunately, are not always discernible due to overlying snow, and even when visible, their thickness may easily be misjudged. Solutions designed to negotiate an IIFW event have focused, therefore, on means of survival and rescue.

To enable a person who sustained an IIFW event to attain a secure grip on the ice surface and pull himself/herself back onto it, specially adapted ice picks have been devised. An example of such a device is proposed in patent application W09411243A1 (Martti T. Hotti, 1994). A sharp-tipped, hand-held pole that is intended to be used in a similar manner is taught in patent U.S. Pat. No. 5,827,098A (Alan D. Cunningham, 1998).

Effective as the aforementioned and other dedicated survival implements are, one must be mindful of the possibility of disaster on an outdoors excursion to carry along survival tools. One seldom contemplates this possibility, though, and most people do not carry survival tools with them on hikes. Moreover, the application of a device of either of the types described above to "claw" one's way back onto sound ice demands a certain level of athletic ability, which many people lack. Unless in possession of such a device, at the time of the incident, and of the ability to wield it effectively, a person who sustained an IIFW event will have great difficulty to exit the water and may be completely dependent on a timely rescue by a person close at hand to survive.

Rescue implements intended for an IIFW event include sleds, and various buoyant and shore-based access platforms—relatively large and heavy devices. Somewhat more portable are marine rescue implements designed for a man-overboard emergencies. The most ubiquitous of such implements is a tethered, weighted buoyant body to which is attached a looped strap or rope to be engaged by the person in need of rescue ("rescuee", hereafter), with the rescue line stowed compactly within the buoyant body before deployment, and is extracted from it progressively when it is cast. One example of such a device is proposed in patent application WO2004/056653Al (Lars-Hakan Lendqvist, 2004). Another example is taught in patent U.S. Pat. No. 6,659,823B1 (Kirk Mosna, 2003). These implements are still too bulky to be truly portable, and are not likely to be carried along on terrestrial excursions. A similar but simpler type of marine rescue device is taught in patent US006575799B1 (Richard Stimpson, 2003) and patent U.S. Pat. No. 4,661,077A (Bruce S. Griffith, 1987). In these devices the rescue line is stowed separately from the buoyant body. Again, both devices are too unwieldy to be encumbered with on a hike.

Another type of marine rescue implement employs a tubular boom fitted at its distal end with a looped line by which to engage and pull to safety a person overboard. One example of such a device is taught in patent U.S. Pat. No. 4,599,074A (David E. Beckly, 1986), and another in patent U.S. Pat. No. 5,752,731A (Robert D. Crone, 1998). Deployed to effect rescue after an IIFW event, a device of this type would force the person attempting the rescue to approach the rescuee to within the limited reach of the device. This would subject the rescuer to the risk of breaking through the ice himself/herself. Under certain circumstances, such as when an VFW event occurs near a lakeside dock, a pole-mounted loop could be effective, but under more typical circumstances, the use of a pole-mounted loop to effect rescue after an IIFW event is inadvisable.

Pole-mounted hooks intended or suitable for rescue after an IIFW event are also known. One example is disclosed in patent U.S. Pat. No. 5,827,098A (Alan D. Cunningham, 1998). Another example is shown in patent U.S. Pat. No. 5,116,093A (O. Edward Burns, 1992). The forgoing comments respecting the limited utility of pole-mounted loops apply similarly to pole-mounted hooks.

A disadvantage shared by existing tethered rescue devices and pole-mounted loops and hooks is encountered when a rescue after an IIFW event is attempted far offshore on an open ice field. Due to the absence of accessible land fixtures to serve as anchorage and due to the minimal traction on ice, it may not be possible for the rescuer to exert the necessary pulling force on the rescue line or pole, after successful engagement with the rescuee, without the rescuer sliding or slipping on the ice surface.

There remains a need, evidently, for a means by which to effect rescue after an IIFW event, which overcomes the aforementioned shortcomings of existing solutions. The present invention addresses this need.

SUMMARY OF THE INVENTION

It is the first object of the present invention to provide a walking accessory to aid in balance and support of a person ambulating upon ice-covered ground or a frozen body of water, and to reduce the risk of slipping.

A second object of the present invention is to provide a walking accessory, as described above, which may also serve as a survival tool by which a person who sustained an IIFW event can exit the water and return to sound ice.

A third object of the present invention is to provide a walking accessory, as described above, which may also serve as a means of rescue by which a person who sustained an IIFW event may be engaged and pulled to safety, effectively and without compromising the safety of the rescuer.

These objects are met in different aspects of the present invention through several features, as outlined below.

In its principal aspect, the present invention is a walking staff having a sharp metal tip, whereby the staff may be secured at a fixed point of contact with an underlying ice surface.

In its second aspect, the present invention is a survival tool, effectual in recovering from an IIFW event. The aforesaid metal tip allows the staff to be used as an ice pick by which one may "claw" his/her way back onto the ice ledge. Having a buoyant sleeve over most of its length, the staff may also serve as an effective PFD (Personal Flotation Device). A hook-shaped foot peg is hinged to the staff, whereby one may engage a land fixture, after having sustained an IIFW event, and pull oneself to safety.

In its third aspect, the present invention is a rescue implement, which may be effectively applied in an IIFW event situation. The aforesaid foot peg, when stepped upon, presses the metal tip onto the ice, securing the staffs point of contact with the underlying ice surface, whereby it may serve as an anchor for an internally stowed, tethered rescue loop (hereinafter, the rescue loop and its tether line are collectively termed "rescue line"). A buoyant projectile is provided, releasably coupled to the staff and linked to the rescue line, which, due to its weight, allows the loop to be cast the full extent of its tether.

These and other objects and features of the present invention are fully expounded hereafter in the description of the preferred embodiments, in which references are made to accompanying drawings, described next.

BRIEF DESCRIPTION OF THE SEVERAL VIEWS OF THE DRAWING

A detailed description of a preferred embodiment of the present invention is provided hereafter, in which references are made to the following figures.

DETAILED DESCRIPTION OF THE INVENTION

Figure 1:
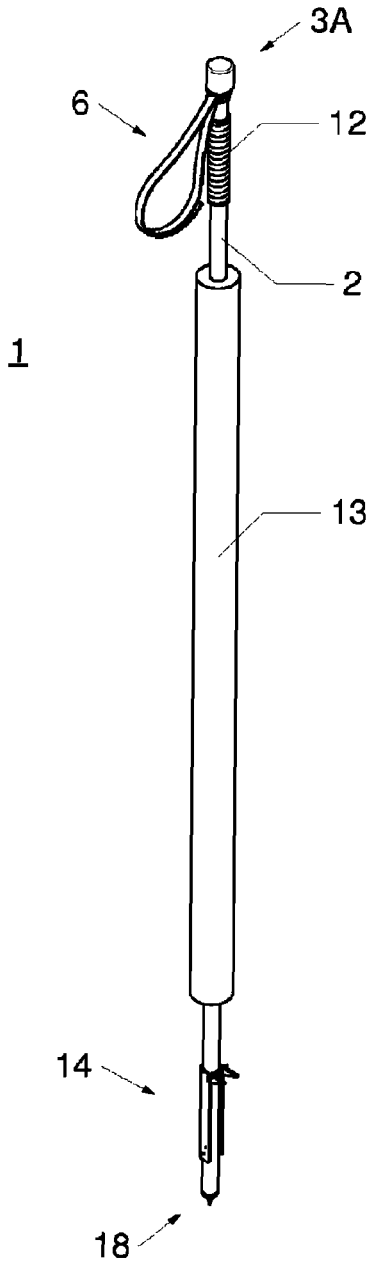
FIG. 1—A perspective isometric view of a first embodiment of a walking staff, according to the present invention.

A first, preferred embodiment of the walking staff according to the present invention is shown in FIG. 1, denoted generally by the numeral 1. The constituent assemblies and components of this embodiment that are indicated in FIG. 1 are termed in this description and in the appended claims (and denoted in FIG. 1) as follows: pole (2), loop carrier (3A), strap assembly (6), handgrip (12), buoyant sleeve (13), foot peg assembly (14), and tip unit (18). An important component of the present invention that is not seen in FIG. 1 is the aforesaid rescue line, which is described in later paragraphs and depicted in corresponding figures.

Pole 2, in this first preferred embodiment, consists of a fixed-length, single tube, which is formed of a strong but lightweight material including, but not limited to aluminum, titanium, and glass- or carbon-fibre-reinforced polymer. In an alternative embodiment (not shown), a height-adjustable pole is used, comprising preferably two, but possibly more telescoping tubes, formed of one or a combination of the aforesaid materials, and interconnected preferably via a collet mechanism of conventional design (e.g. patent U.S. Pat. No. 3,284,114A; W. McCord, 1966).

Figure 5:
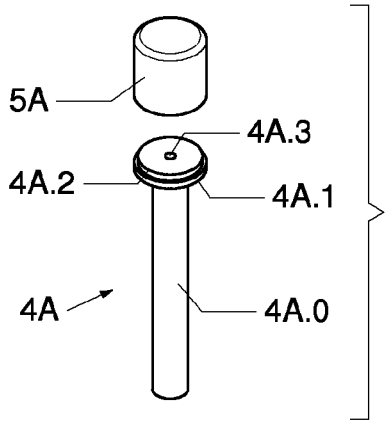
FIG. 5—A perspective exploded view of a first embodiment of a loop carrier according to the present invention.

Loop carrier 3A, shown isolated in FIG. 5, comprises projectile 4A and canister 5A. Projectile 4A is engaged with the rescue loop, and is a buoyant body of sufficient weight to carry the loop, when jointly cast, to the full extent of the tether line. Projectile 4A is releasably coupled to pole 2 by an elongated, cylindrical member 4A.0, which is ordinarily disposed within the top of pole 2, and is retained frictionally therein. Flange 4A.1 abuts the top edge of pole 2, when member 4A.0 is fully inserted. Extending from flange 4A.1 is boss 4A.2, which is threaded to couple with canister 5A. Canister 5A contains the rescue loop, much constricted, as described later. Projectile 4A is formed or adapted with channel 4A.3, which extends longitudinally therethrough, and which admits the line segment trailing from the slip-knot forming the rescue loop, as described fully later. Loop carrier 3A is seen clearly in relation to pole 2 in FIG. 6 and in the corresponding sectional view of FIG. 7.

Figure 9:
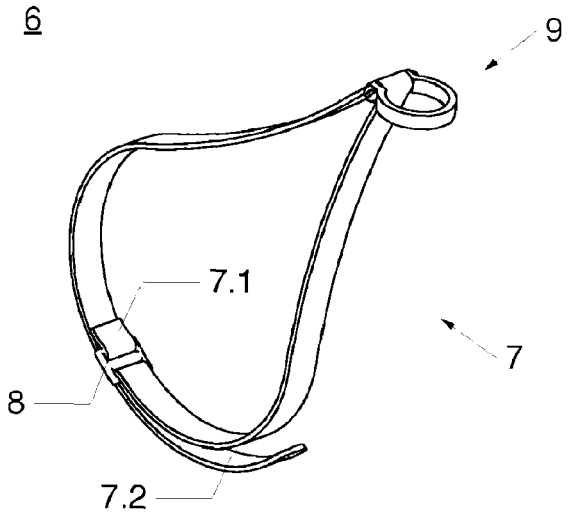
FIG. 9—A perspective isometric view of the wrist strap assembly of the present invention.
Figure 10:
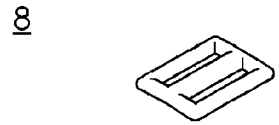
FIG. 10—A perspective isometric view of the wrist strap buckle.

Wrist strap assembly 6, shown isolated in FIG. 9, consist of adjustable strap 7 and strap clamp 9. Adjustable strap 7, in the preferred embodiments, has end section 7.1 thereof fixedly looped over one side of double-slot buckle 8 (shown isolated in FIG. 10), and has elongated end section 7.2 thereof adjustably looped over the other side of buckle 8. End section 7.2 is fixed in position by folding it back onto the corresponding strap section and connecting it detachably thereto via hook-and-loop straps (not shown) affixed to their facing surfaces.

Those skilled in the art will appreciate that strap 7 may take the form of any one of the large variety of strap designs fixed or adjustable in circumference—which are known in the art, and incorporate any one of the many types of clasps and buckles known in the art as a means of adjustment and closure.

Figure 11:
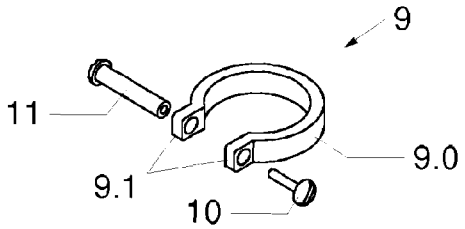
FIG. 11—A perspective isometric view of the strap clamp and fasteners of the wrist strap assembly.

The Strap 7 is mounted onto pole 2 via clamp 9, shown isolated in FIG. 11. Clamp 9 consists of open-ended annulus 9.0, which encircles pole 2 over most of its circumference. Extending outwardly from the two ends of annulus 9.0 are parallel lugs 9.1. Screw 10 and barrel nut 11 are each disposed through a matching aperture in the respective lug 9.1, and are coupled therebetween, tightening clamp 9 about pole 2, while serving as a mounting rod for strap 7.

An alternative clamp (not shown) encircles pole 2 nearly fully, disposing lugs 9.1 closely apart and having a threaded fastener or a rivet connecting the lugs and passing through registering grommeted holes in a wrist strap mounted therebetween.

Figure 2:
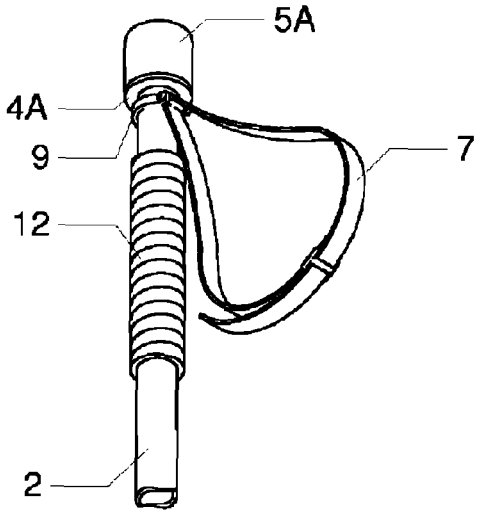
FIG. 2—A perspective view of a top section of the walking staff of FIG. 1.
Figure 6:
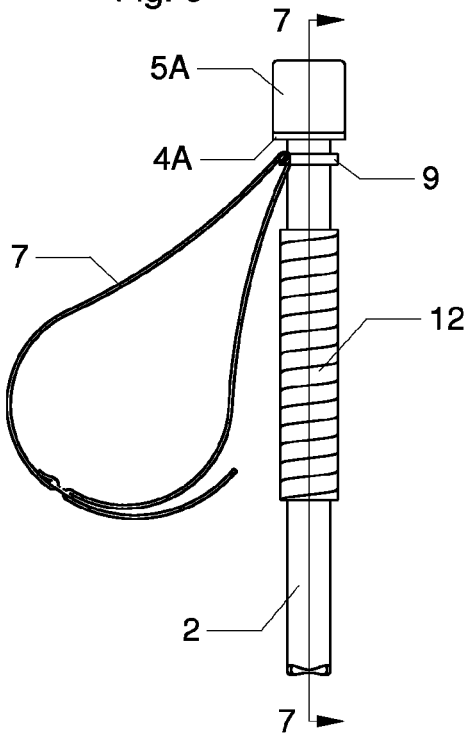
FIG. 6—An orthogonal side view of a top section of the walking staff of FIG. 1.
Figure 7:
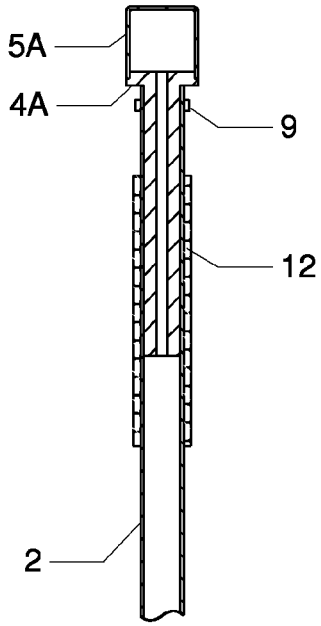
FIG. 7—A sectional view corresponding to line 7 of FIG. 6, showing the loop carrier of FIG. 5 in relation to the staff.

Handgrip 12, best seen in FIGS. 2 and 6, provides a comfortable surface for a prolonged hand grip, and minimizes slippage. Handgrip 12, in the preferred embodiments, is advantageously formed of a length of tape with an adhesive backing, which is wound spirally about pole 2 to sheath it in a continuous layer of sufficient length for a convenient hand grip. The tape forming handgrip 12 is constructed of or comprises a cushioning material, or a combination of such materials, including, but not limited to, cork, rubber, leather, foam, and gel. Handgrips of the aforesaid description are well-known in the field of bicycle handlebar tapes. Alternatively, handgrip 12 may be a foam sleeve, friction-fitted or bonded to pole 2.

Buoyant sleeve 13, shown in FIG. 1, provides staff 1 with the buoyancy to remain afloat, if dropped in the water, and further, to aid in keeping its bearer afloat after an IIFW event. Sleeve 13 also provides a comfortable surface for the forceful hand grip required to stabilize pole 2 when used for anchorage with the attached rescue line. In the preferred embodiments, sleeve 13 is formed of resilient closed-cell foam (e.g. expanded polyethylene foam), but could alternatively be formed of other buoyant materials, such as rigid closed-cell foam, balsa wood, or cork. Buoyant sleeve 13, in the preferred embodiments, sheaths pole 2 over most of its length, and is affixed frictionally thereto.

Figure 3:
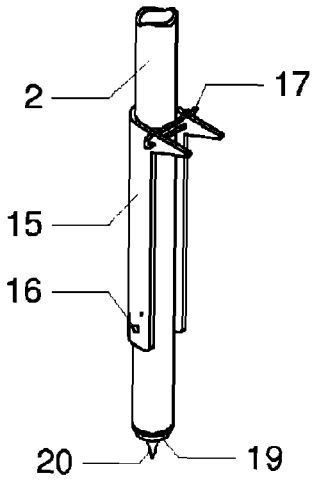
FIG. 3—A perspective isometric view of a bottom section of the walking staff of FIG. 1, with the foot peg in a retracted orientation.
Figure 4:
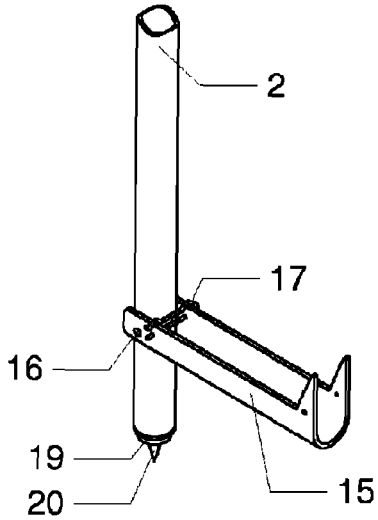
FIG. 4—A perspective isometric view of a bottom section of the walking staff of FIG. 1, with the foot peg in a deployed orientation.
Figure 12:
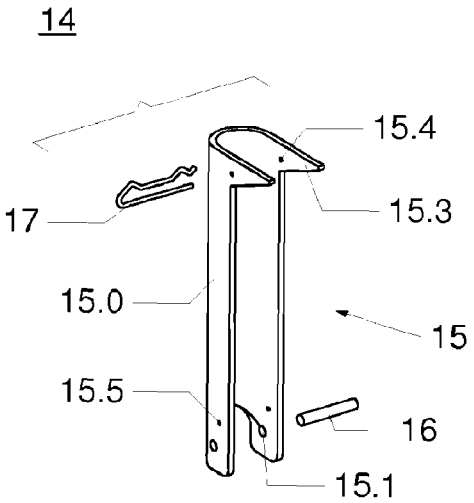
FIG. 12—A perspective isometric, exploded view of a preferred embodiment of the foot peg assembly and its lock clip and hinge pin.
Figure 13:
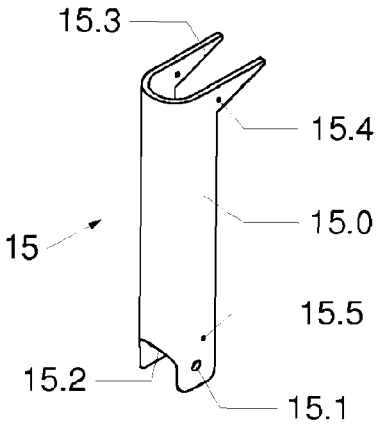
FIG. 13—A perspective rear view of the foot peg.

Foot peg assembly 14 is shown isolated in FIGS. 12 and 13, and in relation to a bottom section of pole 2 in FIGS. 3 and 4. In its retracted orientation, depicted in FIG. 3, foot peg 15 is aligned with pole 2, protruding minimally to avoid interference with ground or personal objects while walking. In its deployed orientation, depicted in FIG. 4, foot peg 15 projects sideways at substantially a right angle to pole 2, providing a foot hold, whereby staff 1 may be forcefully pressed by foot pressure to firmly and immovably plant its pointed tip on the underlying ice surface, thereby to serve as reliable anchorage for the rescue line, as described later. Foot peg 15 may also function as a handhold, when deployed, to be grasped by a person who sustained an IIFW event, if within reach, or as a hook, by which to engage the clothing of such a person and to pull him/her to safety.

Foot peg assembly 14, comprises foot peg 15, hinge pin 16, and lock clip 17.

Foot peg 15 is formed of sheet metal as an elongated channel of substantially a U-shaped cross-section, having relatively shallow side walls and a rounded back wall. The two side walls of foot peg 15 are fashioned with registering holes 15.1, which admit hinge pin 16. Hinge pin 16 is a plain steel rod, which is friction-fitted within tip unit 18, as described in following paragraphs, protruding radially through corresponding apertures in pole 2. Foot peg 15 is thus free to pivot about pin 16.

The back wall of foot peg 15 conforms to the curvature of pole 2, and is adapted with parabolic notch 15.2 near its hinged end, best seen in FIG. 13. When fully retracted, as seen in FIG. 3, foot peg 15 embraces pole 2—its side walls tangential to the pole; its back wall aligned in abutment with it. When fully deployed, as seen in FIG. 4, foot peg 15 lies perpendicularly to pole 2, abutting it edgewise along notch 15.2, which thus defines the maximum angle foot peg 15 may assume.

Flanges 15.3 extend from the side walls of foot peg 15 along a relatively short section of their length conterminous with its unhinged end. Flanges 15.3 taper to a point, rendering foot peg 15 an effective rescue hook, when deployed, as mentioned above.

Foot peg 15 is further adapted with two pairs of registering pin holes disposed on its side walls—pair 15.4 near its free end, and pair 15.5 near its hinged end. When fully retracted, foot peg 15 may be secured in position by engaging lock clip 17, a modified R-clip, through pin holes 15.4, as seen in FIG.

3. When fully deployed, foot peg 15 may be secured in position by engaging lock clip 17 through pin holes 15.5, as seen in FIG. 4.

It will be apparent to those skilled in the art that the precise geometry of foot peg 15 is not essential to its functionality or effectiveness, a foot peg having a planer or a V-shaped back wall, for instance, being equally effective. It will also be clear to the skilled artisan that an alternative foot peg structure may be constructed as a welded or bolted braced frame. Furthermore, in lieu of a pin for a hinge, a threaded fastener, such as a barrel bolt and nut, may be employed with equal effectiveness.

Figure 14:
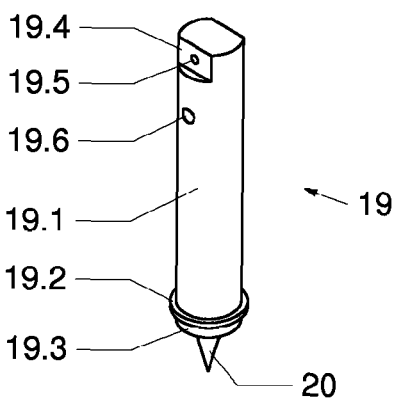
FIG. 14—A perspective isometric view of the tip unit of the present invention.
Figure 16:
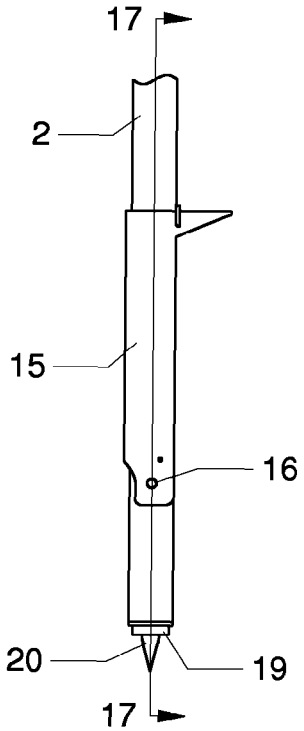
FIG. 16—An orthogonal side view of a bottom section of the walking staff of FIG. 1.
Figure 17:
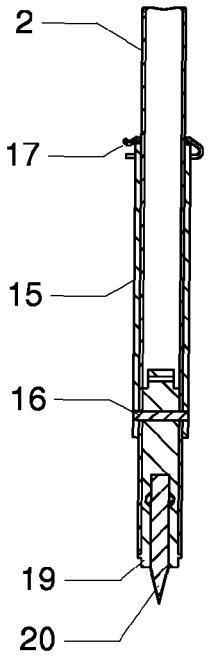
FIG. 17—A sectional view corresponding to line 17 of FIG. 16, showing the tip unit in relation to the staff.

Tip unit 18, depicted isolated in FIG. 14 and in relation to a bottom section of pole 2 in FIG. 16 and the corresponding sectional view of FIG. 17, secures staff 1 at an immovable point of contact with the underlying ice surface, as discussed above, and acts as a fulcrum about which the staff may be pivoted, whereby the attached rescue line may be pulled. Tip unit 18 consists of cladding 19 and spike 20.

Cladding 19, best seen in FIG. 14, is formed of thermoplastic material in the preferred embodiments, and serves as an adaptor by which to affix spike 20, whose top part is embedded therein, to pole 2. Cladding 19 consists of cylindrical member 19.1, flange 19.2, accessory mount 19.3, and lug 19.4, and is further formed or adapted with line hole 19.5 and hinge-pin hole 19.6. Member 19.1 is sized diametrically to fit closely within a bottom section of pole 2, into which it is inserted to the full depth permitted by Flange 19.2. Accessory mount 19.3 is threaded (thread not shown), and is sufficiently long to effectively secure screw-on accessories (described later). Lug 19.4 constitutes the top part of member 19.1 and is defined by two diametrically opposite recesses formed in member 19.1. Lug 19.4 is formed or adapted with line hole 19.5, and is of such thickness that sufficient lateral space remains on either side of its planar faces for an end section of the tether line encapsulated in pole 2 to descend on one side, pass through hole 19.5 and ascend on the other side to be tied in a knot above cladding 19. Lug 19.4 is of such vertical extent that sufficient margin exists above hole 19.5 to withstand the stress lug 19.4 may be subjected to by the attached tether line. Member 19.1 is further formed or adapted with hinge-pin hole 19.6, which bears hinge pin 16, retaining it frictionally therein.

Figure 15:
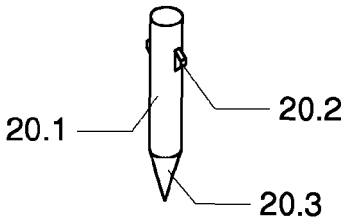
FIG. 15—A perspective isometric view of the spike of the tip unit.

Spike 20, depicted isolated in FIG. 15, is formed in the preferred embodiments of hardened steel and consists of elongated shank 20.1, from which project lobes 20.2, and conical tip 20.3. Shank 20.1 is embedded within cladding 19 and is positively secured by lobes 20.2.

As will be clear to those skilled in the art, the number of lobes and their precise geometry, as proposed in the preferred embodiments, is not essential to the effectiveness of the coupling of spike 20 with cladding 19. Conical tip 20.3, in an alternative embodiment, takes the form of a drill bit, which permits staff 1 to be driven more deeply into the ice to better secure its position. Spike 20, in an alternative embodiment contemplated, is conical in its entirety.

Figure 18:
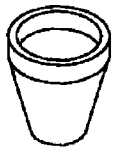
FIG. 18—A perspective isometric view of a tip cover, according to the present invention.
Figure 19:
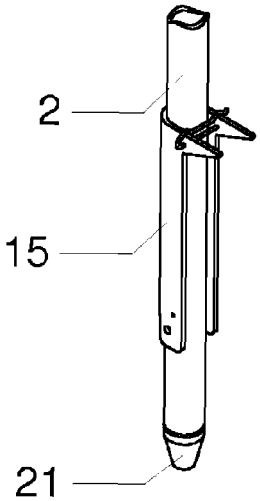
FIG. 19—A perspective isometric view of a bottom section of the walking staff of FIG. 1, fitted with the tip cover.

Tip cover 21 is shown isolated in FIG. 18, and attached to accessory mount 19.3 in FIG. 19. While staff 1 is in storage or during transport, tip cover 21 protects tip 20.3 from damage due to impact with a hard surface, and prevents tip 20.3 from damaging objects and inflicting injuries. Tip cover 21 is preferably molded of thermoplastic material in a cup-shaped form that is threaded internally over its lip for ready attachment to accessory mount 19.3.

Figure 20:
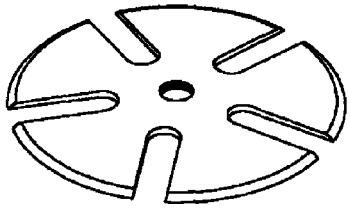
FIG. 20—A perspective isometric view of a pole basket, according to the present invention.
Figure 21:
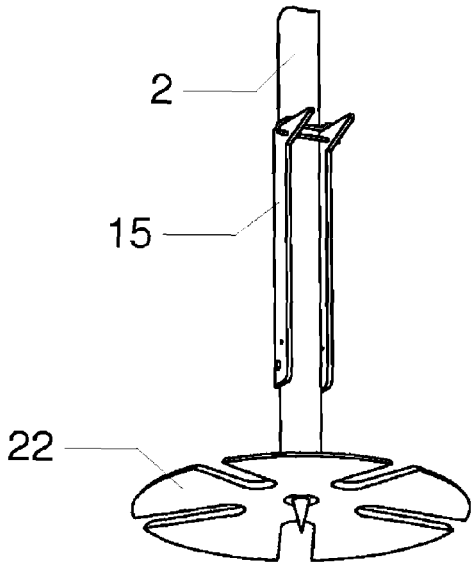
FIG. 21—A perspective bottom view of a bottom section of the walking staff of FIG. 1, fitted with the pole basket.

Pole basket 22 is shown isolated in FIG. 20 and attached to accessory mount 19.3 in FIG. 21. When traversing snowy terrain, Pole basket 22 may be affixed to staff 1 to reduce the depth to which staff 1 sinks into the snow. Pole basket 22 is preferably a molded thermoplastic part, formed with a centrally disposed threaded hole, by which it may be readily attached to accessory mount 19.3.

Tether line 27 and the rescue loop at its head; as seen in FIG. 25-30, are ordinarily stowed within staff 1 and are deployed to engage and pull to safety a person who sustained an IIFW event. Tether line 27 is attached, at its trading end, to cladding 19 of tip unit 18, as described above, and is packed compactly within the shaft of pole 2, in a plurality of transverse folds. This manner packing is best carried out with the use of a ramrod. Alternatively, tether line 27 may be coiled about a rod, the entire assembly inserted into the shaft, and then the rod carefully extracted, leaving the coiled line in the shaft. Tether line 27 is characterised in being buoyant, durable, flexible, and of high tensile strength and minimal elasticity, and is formed of sheathed or unsheathed braided polymer strands. A wide variety of such ropes are commercially available.

Figure 25:
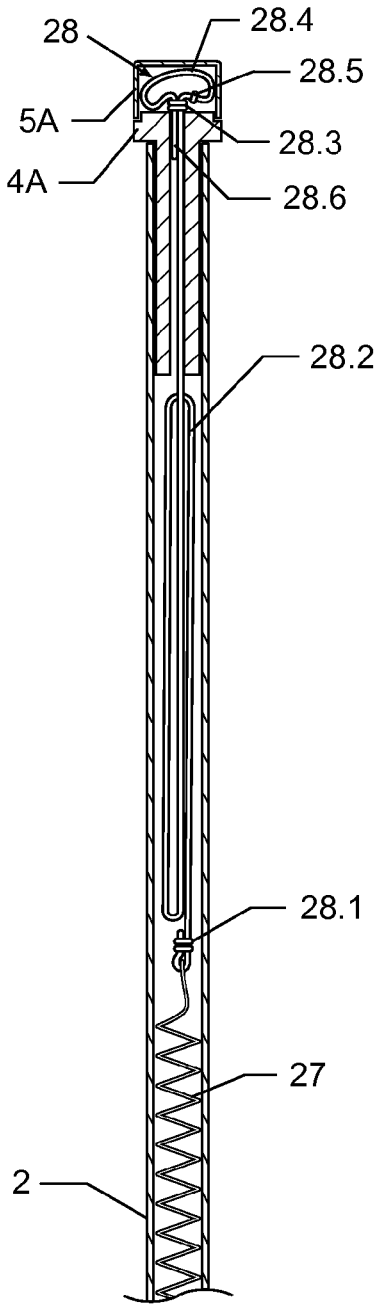
FIG. 25—A sectional view of an upper section of the pole of the first staff embodiment, showing the rescue line, and the first embodiment of the loop carrier.
Figure 26:
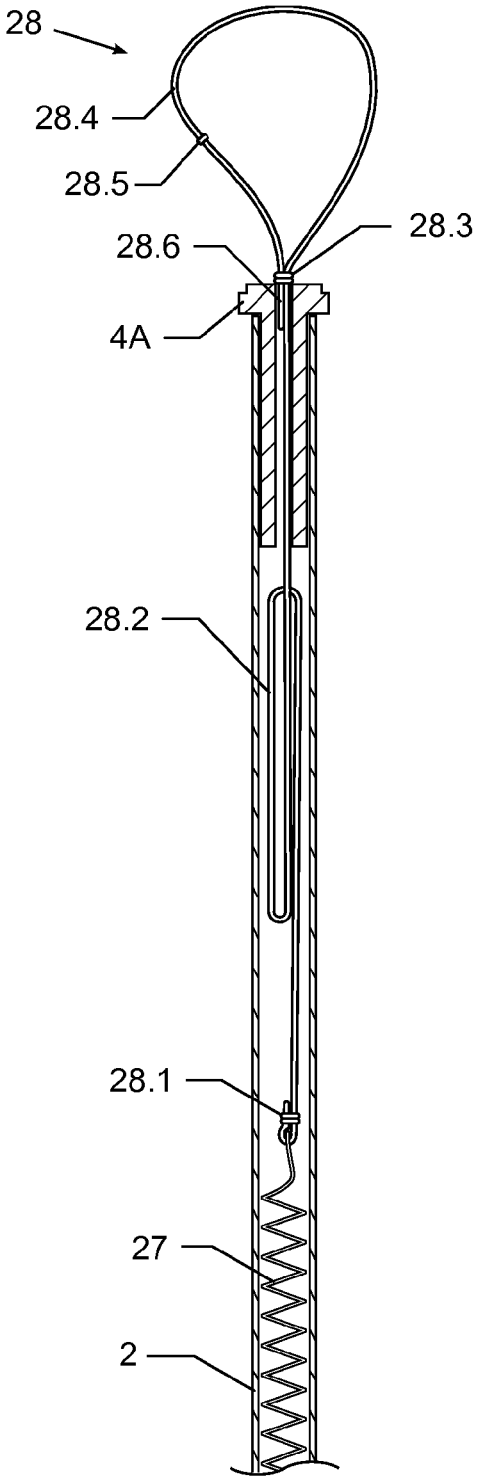
FIG. 26—A sectional view of the pole section of FIG. 25, showing the rescue loop deployed in a first configuration.
Figure 27:
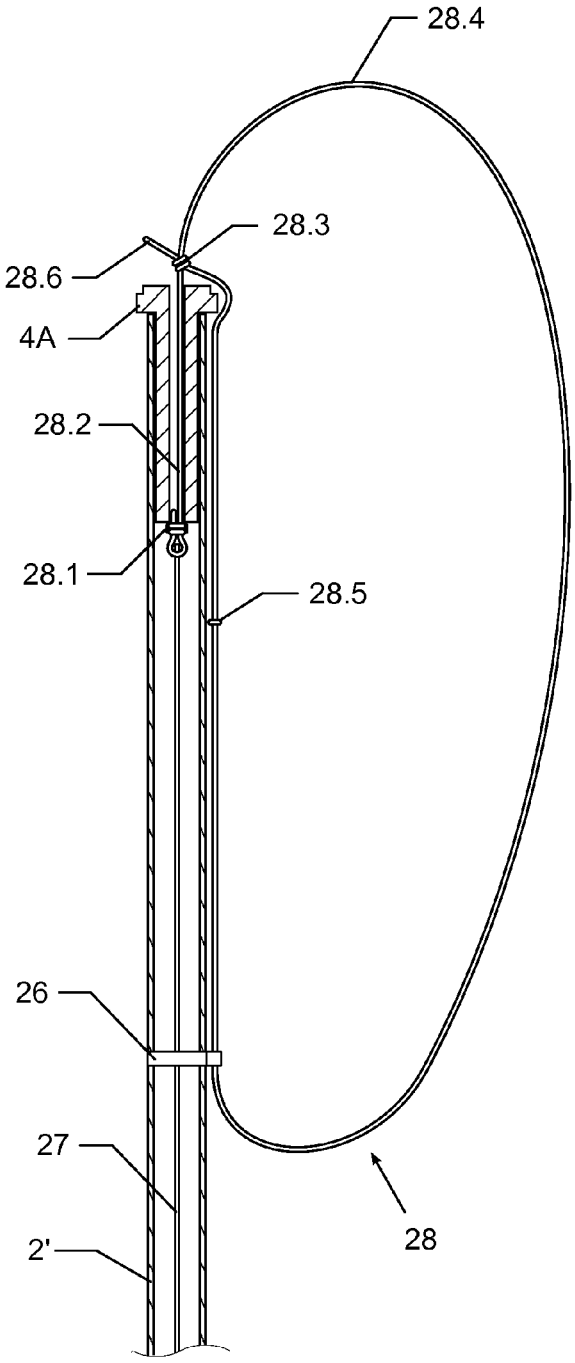
FIG. 27—A sectional view of an upper section of the extended pole of the staff of FIG. 22, showing the rescue loop deployed in a second configuration.

Linked to the leading, free end of tether line 27, according to the first preferred embodiment as depicted in FIG. 25-26, is rescue loop 28, which, advantageously, is adjustable in circumference (but alternatively is of fixed circumference), and is formed of thicker and stiffer material than tether line 27, but is otherwise of similar properties. Loop 28 comprises tether line attachment knot 28.1, trailing segment 28.2, slip-knot 28.3, bight 28.4, stop-knot 28.5, and stub segment 28.6.

Loop 28 links with tether line 27 by knot 28.1, which is diametrically larger than channel 4A.3. Alternative means of connection include, but are not limited to crimp sleeves, and rope connector clamps—a component well known in the art. Trailing segment 28.2 is stowed within pole 2 above tether line 27 in a plurality of vertical folds, and provides sufficient line reserve for expansion of the loop to at least the girth of a man's shoulders. Trailing segment 28.2 passes through channel 4A.3 of projectile 4A and terminates in slip-knot 28.3, which is diametrically larger than channel 4A.3. Slip-knot 28.3 forms adjustable bight 28.4, which is ordinarily encased within canister 5A, maximally constricted. Interposed along bight 28.4 is stop-knot 28.5, which defines the minimum circumference bight 28.4 may assume as approximately that of a person's bare wrist. Depending freely from slip knot 28.3, and consequent to its construction, is stub segment 28.6, which is disposed within channel 4A.3 of projectile 4A alongside an upper part of trailing segment 28.2, and is retained frictionally therewithin. Sufficient friction exists in this configuration to ensure that slip-knot 28.3 (and thus bight 28.4) remains attached to projectile 4A when manoeuvred by pole 2 (a configuration depicted in FIG. 26) or cast (a configuration depicted in FIG. 29), but to allow it to separate from projectile 4A when under tension during rescue.

A walking staff, according to the present invention, features dual instrumentality, being capable of serving either as a rescue implement, or as a survival tool. The first preferred embodiment, according to the foregoing description, allows the rescue of a person who sustained an IIFW event to be effected in one of three ways, as follows:

(a) If it is believed safe to approach the rescuee to within the reach of staff 1 and to execute the rescue from this position, foot peg 15 may be pivoted to the deployed orientation and used as a handhold for the rescuee to grasp, or as a hook by which to engage the rescuee's clothing and pull him/her to safety.

(b) If it is believed safe to approach the rescuee to within the reach of staff 1, but not to execute the rescue from this position, canister 5A may be removed, loop 28 expanded as needed, but kept attached at its base to projectile 4A, as depicted in FIG. 26, and staff 1 manoeuvred to facilitate engagement of loop 28 with the rescuee. Once engaged with an arm or the torso of the rescuee, loop 28 is constricted by swinging staff 1 away from the rescuee. This motion dislodges stub segment 28.6 from channel 4A.3 of projectile 4A and draws trailing segment 28.2 from projectile 4A, until knot 28.1 comes into contact with it, at which point bight 28.4 begins to constrict about the engaged arm or torso of the rescuee. The rescuer then retreats toward a position wherefrom the rescue can be attempted safely. As the rescuer begins to retreat, projectile 4A is dislodged from pole 2, and tether line 27 is progressively drawn out from within the now open-ended shaft of pole 2. When on a safe surface, if traction permits, tether line 27 may be pulled directly to assist the rescuee in exiting the water. If traction is insufficient due to ice cover, tether line 27, unless already fully extracted and taut, is pulled taut and secured to an upper part of staff 1 (e.g. by winding it about the pole a few times), foot peg 15 deployed and stepped on to press spike 20 onto the ice surface, and staff 1 pivoted about its tip to pull tether line 27. By securing tether line 27 to a lower position on staff 1 greater leverage action is obtained, permitting a weaker than average rescuer to exert the necessary pulling force.

Figure 29:
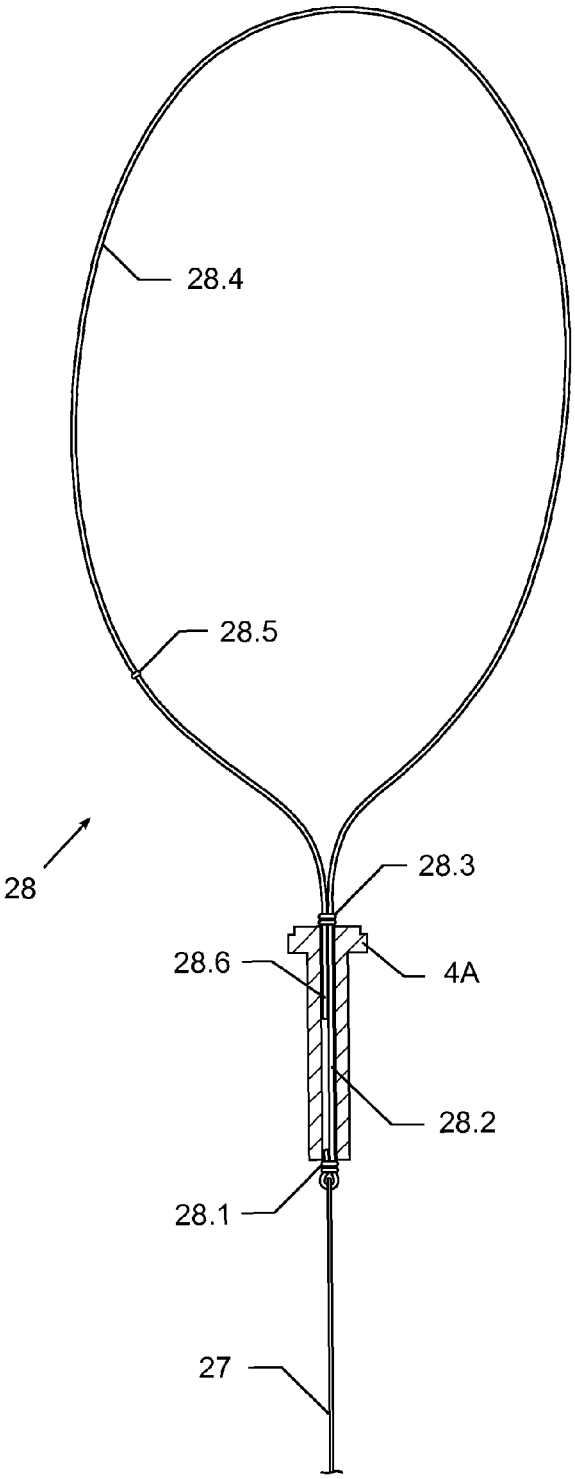
FIG. 29—A sectional view of the projectile of the first embodiment of the loop carrier and the engaged loop after having been cast.

(c) If it is believed unsafe to approach the rescuee to within the reach of staff 1, canister 5A is removed, loop 28 expanded maximally, stub segment 28.6 still lodged within projectile 4A, which is then dislodged from pole 2 and cast towards the rescuee, as depicted in FIG. 29. Once engaged with the rescuee, tether line 27 may be pulled directly, or with the aid of the leverage and traction afforded by staff 1, as in the previous technique. Loop 28, encountering the tension from tether line 27 and the resistance from the engaged rescuee then constricts about the arm or torso of the rescuee.

The first preferred embodiment may be used as a survival tool, after an IIFW event, as follows:

(a) Upon entry into the water, buoyant sleeve 13 may be immediately used as a PFD (Personal Floatation Device) by disposing it across the chest and under the armpits, allowing one to remain afloat without undue effort, to regain composure, and to devise a course of action.

(b) Staff 1 may be grasped at a lower part thereof, and spike 20 used to incrementally "claw" one's way back onto the ice ledge.

(c) Foot peg 15 may be deployed and used as a hook, allowing one to engage a ground fixture or a fixed object on sound ice, and pull oneself ashore or onto the sound ice.

(d) Projectile 4A may be detached from pole 2, foot peg 15 deployed, and staff 1 cast toward a ground fixture or a fixed object on sound ice while retaining projectile 4A, using foot peg 15 as a grapnel by which one may pull oneself ashore or onto the sound ice.

(e) Projectile 4A may be detached from pole 2 and cast toward a rescuer on shore or on sound ice, and pole 2 grasped firmly while being pulled to safety, using foot peg 15 in the deployed orientation, if necessary, for a better grip.

Figure 22:
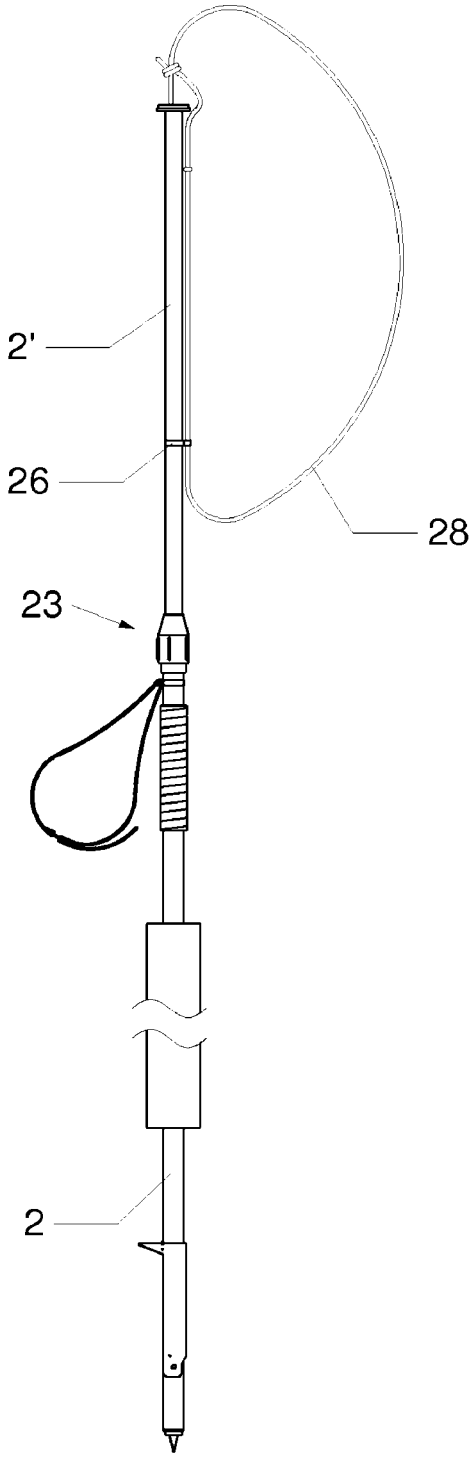
FIG. 22—An orthogonal side view of a second embodiment of the walking staff, comprising an extensible pole.
Figure 23:
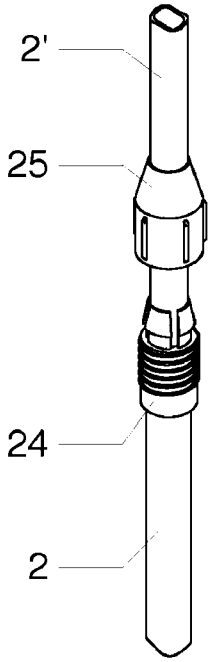
FIG. 23—A perspective isometric view of a collet mechanism and the proximal pole sections of the walking staff depicted in FIG. 22.
Figure 24:
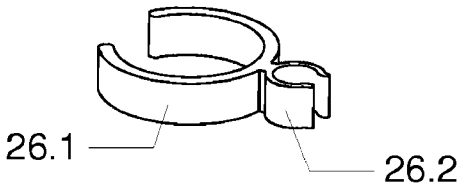
FIG. 24—A perspective isometric view of a loop retainer clamp used with the staff of FIG. 22.

A second preferred embodiment of the present invention is shown in FIG. 22. In this embodiment, staff 1 further comprises inner pole 2', which is telescopically coupled to pole 2 via collet mechanism 23. Shown uncoupled in the larger scale, partial view of FIG. 23, collet mechanism 23 is well known in the art and consists of threaded collet 24, which is bonded or, alternatively, screwed or riveted to pole 2 and collar 25, which is free to slide over pole 2' and is screwed onto collet 24 to secure pole 2' to pole 2. Loop carrier 3A is used in this embodiment, which is coupled to pole 2' in this second embodiment, as it is coupled to pole 2 in the first embodiment. Tether line 27 is attached to lug 19.4, as in the first embodiment, but is stowed within pole 2' in this second embodiment. A preferred, but optional element of this embodiment is loop retainer clamp 26, shown isolated in FIG. 24. Clamp 26 is used to releasably attach loop 28 to pole 2', at such point along its length and at such position along pole 2' that it remains open and is of a circumference favourable to engagement while being manoeuvred by poles 2 and 2'. Clamp 26 is formed of resilient thermoplastic material and consists of two open rings: a pole ring 26.1, which is sized to clamp onto pole 2', maintaining position frictionally, but remaining slideable, and loop ring 26.2, which is sized to resiliently clasp a length of loop line forced therein, yet permit it to be released when forcefully pulled.

This second preferred embodiment is capable of implementing the three rescue techniques afforded by the first preferred embodiment. The first and third rescue techniques of the first preferred embodiment, described above, are executed identically in this second preferred embodiment. The second rescue technique of the first preferred embodiment is modified in this second preferred embodiment by the extension of pole 2' prior to manoeuvring loop 28 into engagement position. The greater reach thus provided allows the rescue to be executed from a safer position on a more solid surface.

The aforesaid survival techniques which may be carried out by the first preferred embodiment may be carried out identically in the second preferred embodiment.

Figure 8:
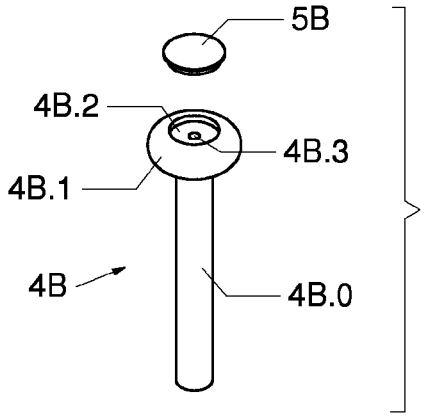
FIG. 8—A perspective view of a second embodiment of a loop carrier according to the present invention.
Figure 28:
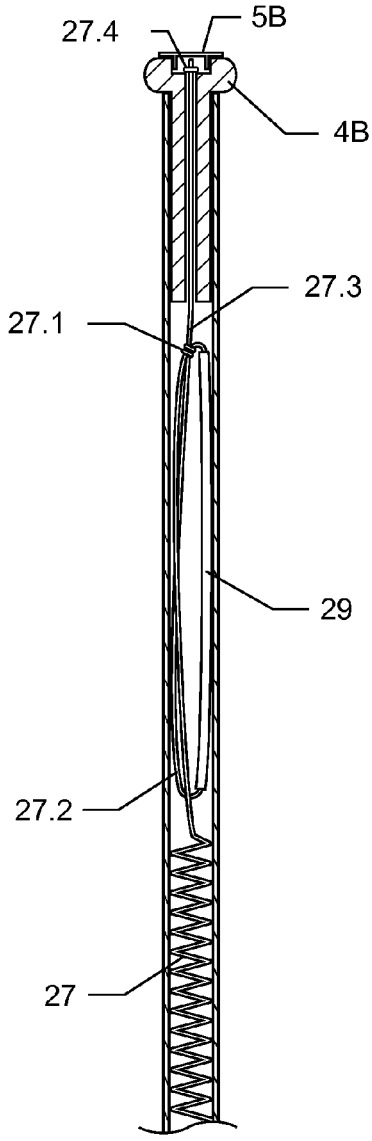
FIG. 28—A sectional view of an upper section of the pole of a third embodiment of the walking staff, showing the rescue line, and the second embodiment of the loop carrier.
Figure 30:
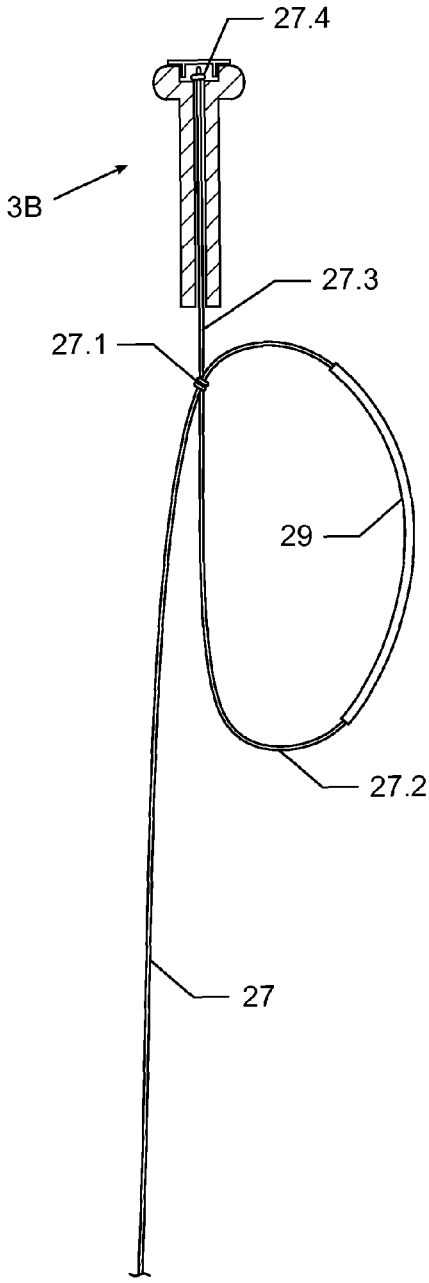
FIG. 30—A sectional view of the second embodiment of the loop carrier and the engaged loop after having been cast.

In a third preferred embodiment of the present invention, depicted in FIG. 28 and FIG. 30, the rescue loop is integral to tether line 27, and comprises slip-knot 27.1, bight 27.2, stub segment 27.3, and end-knot 27.4. This third embodiment comprises a loop carrier of a second form, depicted isolated in FIG. 8 and shown engaged to the rescue line in in FIG. 30 (denoted 3B), which consists of projectile 4B, and cap 5B. Projectile 4B is releasably coupled to pole 2 via cylindrical member 4B.0, which is inserted therein and retained frictionally, but releasably. Member 4B.0 is topped with knob 4B.1, which is formed with recess 4B.2, and has longitudinal channel 4B.3 passing therethrough. As seen in FIG. 28, slip-knot 27.1 and bight 27.2 are ordinarily stowed within the shaft of pole 2 in this third embodiment. Slip-knot 27.1 is formed with elongated stub segment 27.3, which rises through channel 4B.3, and is terminated with end-knot 27.4, which is diametrically larger than channel 4B.3. End-knot 27.4 is seated within recess 4B.2 of knob 4B.1, and is covered with friction-fitted cap 5B. Cap 5B protectively seals end-knot 27.4 and provides loop carrier 38 with a smooth top surface. Bight 27.2 is at least partly sheathed in sleeve 29—a resiliently contractible braided sleeve, elastically biased to an expanded state, of the type used for electrical wire protection (e.g. U.S. Pat. No. 4,754,685A; J. S. Kite, 1988). Sleeve 29 ensures that bight 27.2 remains open when cast, as seen in FIG. 30, but permits it to constrict around a person's torso, when deployed.

Rescue, in this third preferred embodiment, may be effected in one of two ways:

(a) if it is believed safe to approach the rescuee to within the reach of staff 1 and to execute the rescue from this position, foot peg 15 may be pivoted to the deployed orientation and used as a handhold for the rescuee to grasp or as a hook by which to engage the rescuee's clothing, and pull him/her to safety, as in the first preferred embodiment.

(b) If it is believed unsafe to approach the rescuee to within the reach of staff 1, loop carrier 38 may be detached from pole 2, bight 27.2 adjusted in circumference to form an opening and set by slip-knot 27.1, and loop carrier 3B then cast towards the rescuee. Once engaged with the rescuee, tether line 27 may be pulled directly, or with the aid of the leverage and traction afforded by staff 1, as in the first preferred embodiment.

The aforesaid survival techniques of the first preferred embodiment may be implemented similarly with the third preferred embodiment.

It is to be understood that the forgoing description of the preferred embodiments of the present invention and the accompanying drawings are intended to better elucidate the invention by way of examples, and not in any way to narrow its purview or the scope of the appended claims to the embodiments exemplified.

The invention claimed is:

1. A multi-functional walking staff comprising:

(a) a hollow, elongated, handheld pole, which comprises one or a plurality of telescopically interconnected tubes, and which is dimensioned to conveniently and reliably aid in balance and support of a walking person, and to encapsulate, partly or wholly, a rescue line;

(b) A buoyant rescue line consisting of (a) a tether line section, which is compactly stowed within said pole in a plurality of folds or windings, and is attached at one end thereof to said pole, and (b) a rescue loop formed at the other end of said tether line or adjoined thereto, thereby to engage an arm or the torso of a person who suffered an Involuntary Immersion in Freezing Water event;

(c) a buoyant projectile, which is disposed atop said pole or uppermost of said interconnected tubes thereof, coupled frictionally, but releasably therewithin, which projectile being engaged with said loop and is of sufficient weight to carry the loop, when jointly cast, to the full extent of said tether line;

(d) a tip unit, which consists of a metal spike having a top section thereof embedded within a cladding that is inserted within a bottom section of said pole, and having a pointed bottom section thereof projecting downwardly from said cladding;

(e) a foot peg, which is mounted to said staff at a bottom part thereof, whereby said spike may be forcefully pressed by foot pressure onto the an underlying ice surface and lodged superficially within at an immovable point of contact.

2. The walking staff defined in claim 1, wherein said projectile comprises a longitudinal channel having a line segment of said rescue loop passing therethrough, whereby the projectile is engaged with the loop.

3. The walking staff defined in claim 2, wherein said rescue loop is disposed externally of said pole, above said projectile, or internally of said Dole, underneath said proiectile, the line from which it is formed and extending therefrom passing through said channel of the projectile, and connecting integrally or linking with said tether line.

4. The walking staff defined in claim 3, wherein said rescue loop is circumferentially adjustable and comprises a stop-knot, whereby the minimal circumference the loop may assume is defined.

5. The walking staff defined in claim 4, wherein said projectile is fitted with a cup-shaped, threaded canister, which is screwed onto the top thereof, thereby to accommodate said rescue loop when at least set to its minimal circumference.

6. The walking staff defined in claim 3, wherein said spike cladding is threaded, whereby ancillary components may be connected thereto.

7. The walking staff defined in claim 3, wherein said bottom section of said spike, at least in part, takes the form of a drill bit, thereby to positively secure the spike to an underlying ice surface.

8. The walking staff defined in claim 2, wherein said loop is disposed internally of said pole, underneath said projectile, and having a line segment extending therefrom, passing through said channel of the projectile and terminating with an end-knot, which end-knot is diametrically larger than the channel.

9. The walking staff defined in claim 8, wherein said rescue loop is circumferentially adjustable.

10. The walking staff defined in claim 9, wherein said rescue loop comprises a stop-knot, whereby the minimal circumference the loop may assume is defined.

11. The walking staff defined in claim 4, wherein said loop is sheathed at least in part in a resiliently contractible, braided sleeve, thereby to sustain the loop expanded when deployed.

12. The walking staff defined in claim 8, wherein said spike cladding is threaded, whereby ancillary components may be connected thereto.

13. The walking staff defined in claim 8, wherein said bottom section of said spike, at least in part, takes the form of a drill bit, thereby to positively secure the spike to an underlying ice surface.

14. A method of rescue of a person who suffered an Involuntary Immersion in Freezing Water event, comprising the steps of:

(a) providing a handheld pole, comprising: a pointed metal tip; a foot peg; a tether line, which is ordinarily stowed within said pole and is attached thereto, and which is formed or connected with a rescue loop; a projectile, which is releasably attached to said pole and is linked to said rescue loop;

(b) adjusting said rescue loop as necessary to facilitate engagement with said person;

(c) positioning said rescue loop to facilitate engagement with said person;

(d) upon successful engagement with said person, retreating to a position from which rescue may be safely executed;

(e) applying foot pressure on said foot peg to forcefully press said spike onto the underlying ice surface;

(f) drawing the tether line taut, unless said tether line has been fully unravelled and is already taut, and securing it to said pole at an upper part thereof or lower, for greater leverage;

(g) incrementally pulling said tether line to aid said person in exiting the water.

15. The method of rescue defined in claim 14, wherein step (c) is performed by manoeuvring said pole to a position favourable to engaging said loop with said person, if within the reach of the pole, or, if beyond the reach of the pole, by detaching said projectile from the pole and casting it, and the rescue loop linked thereto, toward said person.

16. The method of rescue defined in claim 14, wherein step (g) is accomplished by performing the following procedure iteratively, as necessary: pivoting said pole about its tip to execute the pulling action, retreating to draw the line taut, replanting the pole on the ice, and stepping on said foot peg.

17. The method of rescue defined in claim 14, wherein step (g) is accomplished by performing the following procedure iteratively, as necessary: pivoting said pole about its tip to execute the pulling action, reversing the pivoting motion, winding the line about the pole to eliminate slack, at an upper part thereof or lower, for greater leverage.

* * * * *